US006910396B2

(12) United States Patent
Sensolo

(10) Patent No.: US 6,910,396 B2
(45) Date of Patent: Jun. 28, 2005

(54) HAND-HELD MULTI-TASK DEVICE FOR DETECTING WARFARE AND STRATEGIC TRAPS

(76) Inventor: Arie Sensolo, 19 Harel Street, Afridar, Ashkelon 78649 (IL)

( * ) Notice: Subject to any disclaimer, the term of this patent is extended or adjusted under 35 U.S.C. 154(b) by 316 days.

(21) Appl. No.: 10/288,311

(22) Filed: Nov. 6, 2002

(65) Prior Publication Data

US 2003/0084735 A1 May 8, 2003

Related U.S. Application Data

(63) Continuation-in-part of application No. PCT/IL01/00407, filed on May 9, 2001.

(51) Int. Cl.[7] ..... G01D 21/00
(52) U.S. Cl. ..... 73/866.5
(58) Field of Search ..... 73/432.1, 866.5, 73/81, 82, 84, 85, 11.01, 12.14; 81/484, 488, 180.1, 181; 33/391–394

(56) References Cited

U.S. PATENT DOCUMENTS

| | | | | | |
|---|---|---|---|---|---|
| 1,230,074 | A | * | 6/1917 | Perkins | 33/342 |
| 3,478,438 | A | * | 11/1969 | Lazar | 33/394 |
| 5,473,819 | A | * | 12/1995 | Byers et al. | 33/339 |
| 5,704,131 | A | * | 1/1998 | Courtney | 33/394 |
| 5,809,600 | A | * | 9/1998 | Cachot | 7/128 |
| 6,282,943 | B1 | * | 9/2001 | Sanders et al. | 73/23.2 |
| 6,481,110 | B1 | * | 11/2002 | Butler | 33/393 |

FOREIGN PATENT DOCUMENTS

| | | | | |
|---|---|---|---|---|
| DE | 000902914 | * | 1/1954 | 73/12.14 |

* cited by examiner

*Primary Examiner*—Robert Raevis
(74) *Attorney, Agent, or Firm*—Dekel Patent Ltd.; David Klein

(57) ABSTRACT

A hand-held multi-task device comprising a handle, a pendulum pivotally attached to the handle, an adjustable-length rod attached to the handle, and at least one prodder attached to the handle.

5 Claims, 3 Drawing Sheets

HAND-HELD MULTI-TASK DEVICE FOR DETECTING WARFARE AND STRATEGIC TRAPS

CROSS REFERENCE TO OTHER APPLICATIONS

This application is a continuation-in-part of PCT patent application PCT/IL01/00407 filed May 9, 2001, and claims priority therefrom.

FIELD OF THE INVENTION

The present invention relates to a hand-held multi-task device for detecting warfare and strategic traps. More specifically, the present invention relates to a hand-held multi-task device that is especially useful for military or police purposes when it is necessary to search an area and/or object suspected of having concealed mines, grenades, suspension wires wired to explosive devices, or other strategic devices.

BACKGROUND OF THE INVENTION

A variety of means for detecting mines, booby traps and other explosives are known in the art. Each of these known means is configured and designed for the detection of a particular known type of explosive or trap.

However, since numerous explosives and traps can be put in one area, a soldier (a "soldier" is meant to imply a soldier or any other military or police personnel) has to be equipped with several detecting tools and must operate them simultaneously if the threat of accidentally triggering an explosive is to be eliminated in an effective manner. For example, the soldier might be required to carry and simultaneously operate a tool for detecting mines or grenades in or on the ground, a tool for detecting above-waist suspension wires, as well as a tool for detecting below-waist suspension wires (suspension wires are usually connected to explosives that detonate upon disturbance of the wire). The detecting tools can be both cumbersome and uncomfortable for the soldier. Furthermore, since the soldier often has to operate multiple tools at the same time, the job cannot be done as effectively as would be desired, thereby posing a threat to the soldier and to those who pass through the area at a later time. In many cases, it is necessary for more than one soldier to search the same section of land, so that each soldier may be given a specific tool for detecting a particular sort of explosive or trap.

SUMMARY OF THE INVENTION

The present invention seeks to provide a hand-held multi-task device for simultaneously detecting different types of explosives or strategic traps. The present invention may enable, without limitation, efficient detection of above-waist suspension wires, below-waist suspension wires, and mines, grenades or other booby traps that detonate upon disturbance. The device may be easily and effectively operated by one soldier. The device may be stored in a compact and convenient form when not in use.

There is thus provided in accordance with an embodiment of the invention a hand-held multi-task device comprising a handle, a pendulum pivotally attached to the handle, an adjustable-length rod attached to the handle, and at least one prodder attached to the handle.

In accordance with an embodiment of the invention the at least one prodder comprises a plurality of modular connector elements, which are joinable together to form a desired length.

Further in accordance with an embodiment of the invention the pendulum comprises a cord with a weighted element attached thereto.

Still further in accordance with an embodiment of the invention at least one of the pendulum, the rod and the at least one prodder is storable in the handle.

In accordance with an embodiment of the invention one of the modular connector elements comprises a ring member, which may be detachable from the modular connector element.

Further in accordance with an embodiment of the invention the at least one prodder is detachable from the handle.

Still further in accordance with an embodiment of the invention the at least one prodder comprises a tip at an end thereof.

BRIEF DESCRIPTION OF THE DRAWINGS

The present invention is herein described by way of example only, with reference to the accompanying drawings, wherein.

DETAILED DESCRIPTION OF THE DRAWINGS

It should be appreciated that the detailed description that follows is provided to describe certain preferred embodiments of the present invention. It in no way is intended to limit the scope of the invention, as set out in the claims.

Figure 1:
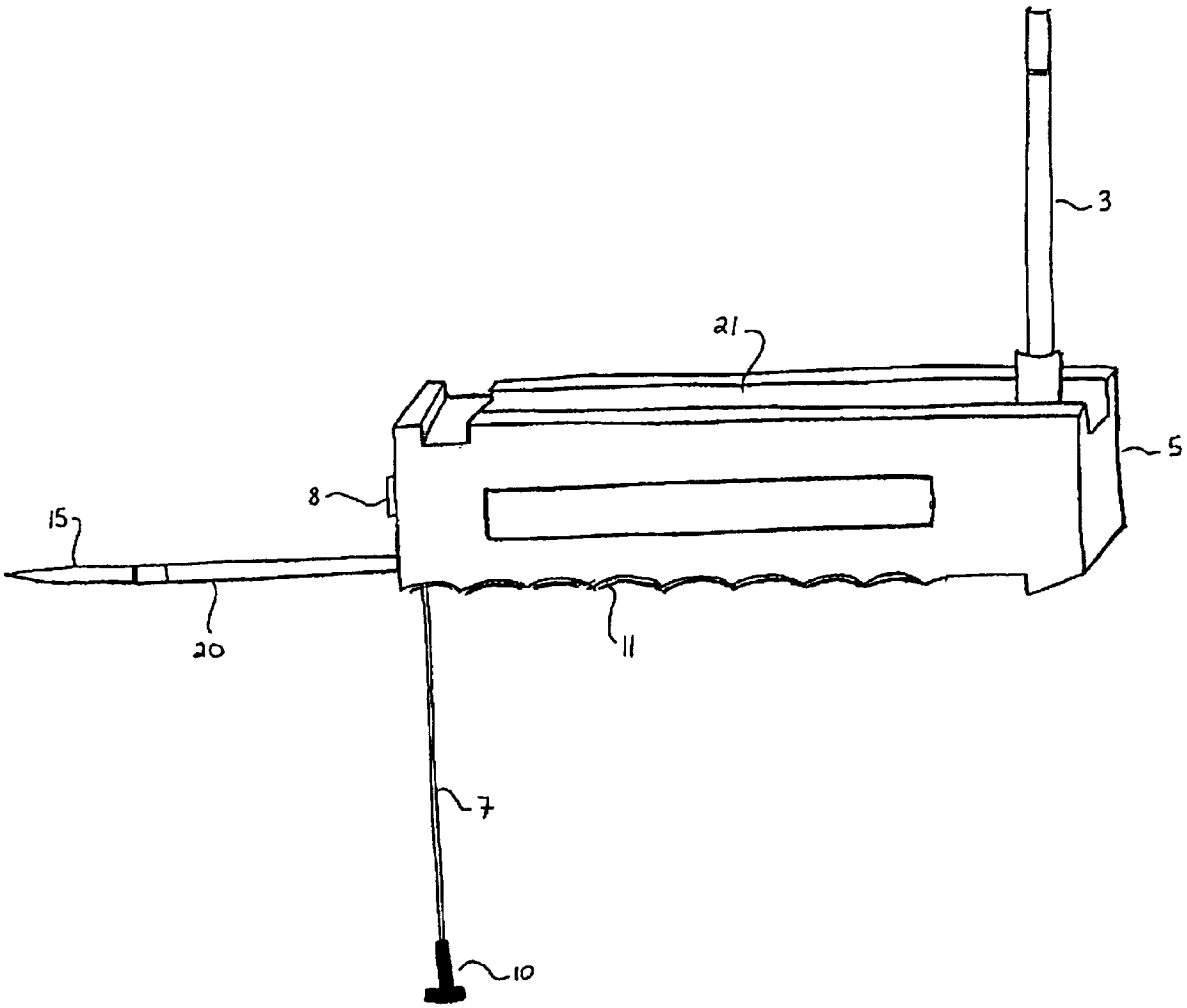
FIG. 1 is an isometric view of a preferred embodiment of the present invention with the weighted element suspended from the handle.

Referring now to FIG. 1, the hand-held multi-task device of the present invention may include a handle 5 of any arbitrary shape, such as but not limited to, a rectangular shape. Handle 5 may be adapted to receive therein components of the device to be described below such that the device can assume a compact and convenient form for example, for storage in a pocket or knapsack. The device may have various components that enable multiple tasks to be performed simultaneously. A cord 7 with a weighted element 10 attached thereto, may be attached to or disposed in handle 5. Cord 7 and weighted element 10 may form a pendulum when suspended from the handle 5 for the purpose of detecting below-the-waist obstacles or suspension wires, which would otherwise be invisible to the eye or barely noticeable. Any obstacle or suspension wire upon contacting the pendulum formed of cord 7 and weighted element 10, disturbs the pendulum, which disturbance is easily detectable by a user holding the device. The user may adjust the length of cord 7 to any desired length. When not in use, cord 7 and weighted element 10 may be stored in handle 5, such as in a recess 8 (seen best in FIG. 3).

The device may also be equipped with an adjustable length rod 3, which may be particularly effective in detecting above-the-waist and overhead obstacles or suspension wires. When not in use, rod 3 may be folded or pivoted downward and received in a lateral slot 21 formed in handle 5. Adjustable length rod 3 may be telescopic.

The device may also be equipped with a first prodder 20 having a pointed tip 15 for aiding in the detection and identification of suspicious objects. The pointed tip 15 may be formed of any suitable material, such as but not limited to, metal or plastic.

Figure 2:
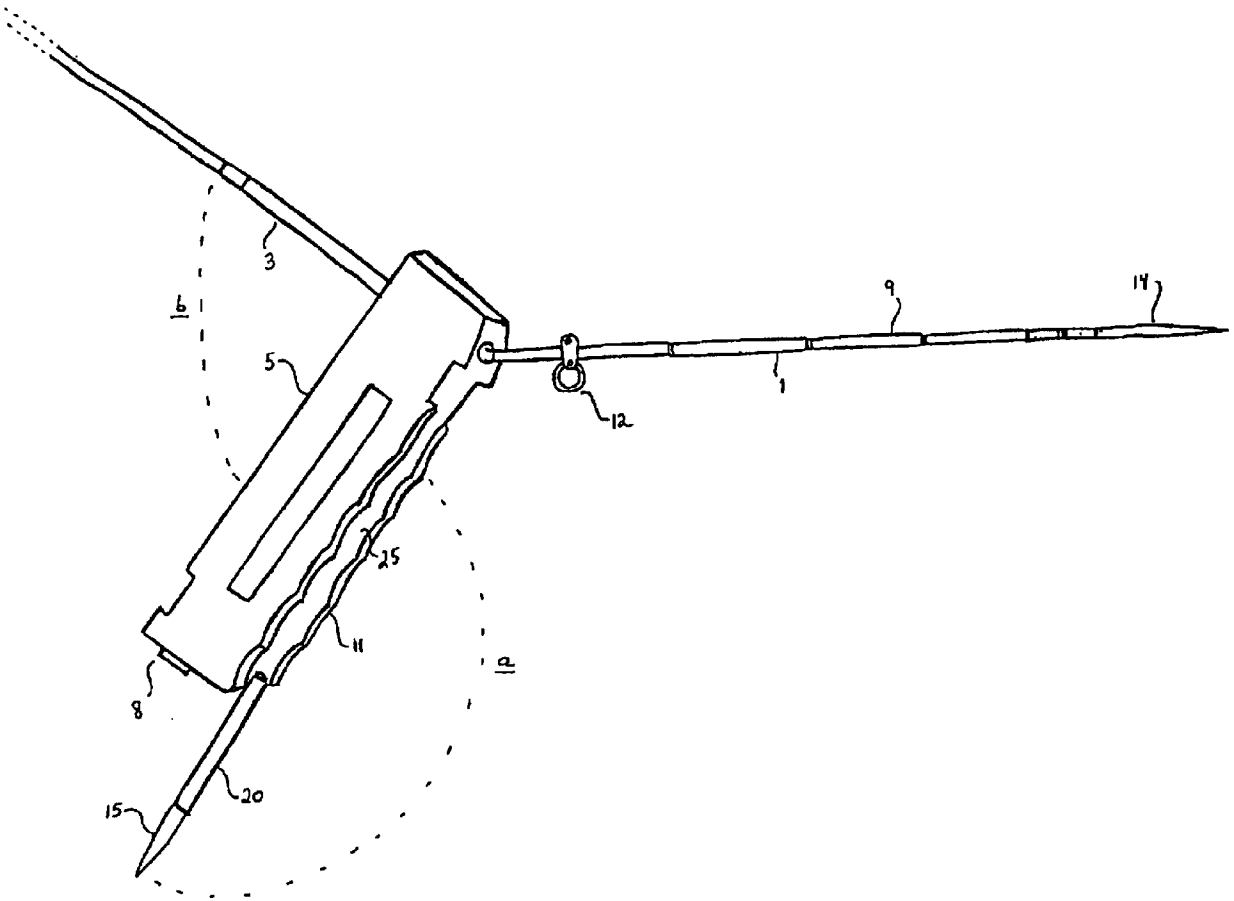
FIG. 2 is an isometric view of a preferred embodiment of the present invention with the second prodder attached to the handle.

Referring now to FIG. 2, a second prodder 9 may be provided, which may be attached at one end thereof to handle 5, by any attachment means, such as but not limited to, a pinned joint or screw connection. The second prodder 9 may aid in detection and identification of suspicious objects on the ground. The second prodder 9 may comprise a plurality of modular connector elements 1. Modular connector elements 1 may be of equal or different sizes, shapes and lengths, and may be joined together by any suitable means, such as but not limited to, press-fit connections, half-turn fits or screw threads, so as to form second prodder 9 of any desired length. A tip 14, formed of metal, plastic, or any other suitable material, may be connected at the end of second prodder 9. One of modular connector elements 1 may comprise a detachable ring member 12 for receiving therethrough a user's finger.

Handle 5 may comprise gripping means, such as but not limited to, a series of indentations 11 located on the bottom side of handle 5.

Referring again to FIG. 2, it is seen that first prodder 20 may be folded into a space 25 formed in handle 5. Dotted lines a and b indicate the manner in which first prodder 20 and rod 3, respectively, may be folded into handle 5. It should also be noted that rod 3 appears in FIG. 2 in a lengthened, extended form, as opposed to FIG. 1, in which rod 3 is shown in a shortened, contracted form.

Figure 3:
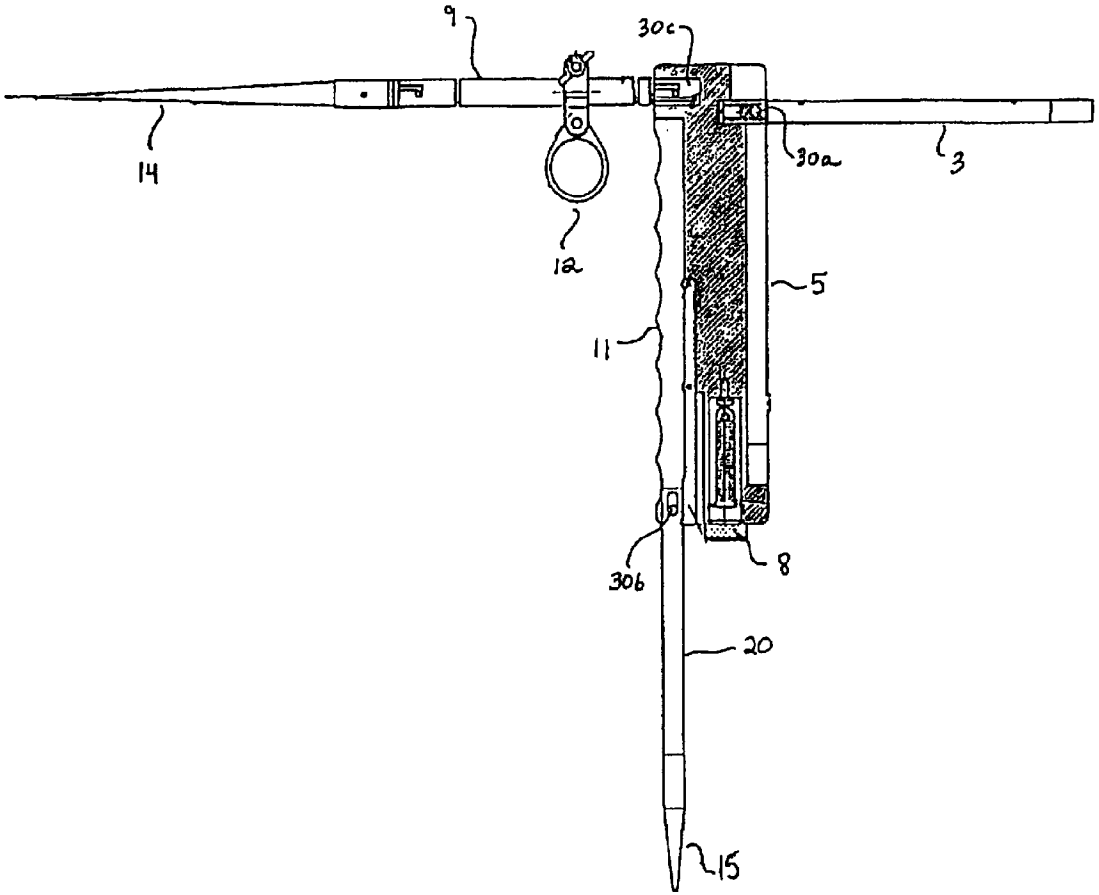
FIG. 3 is a cross-sectional side view of a preferred embodiment of the present invention.

Referring now to FIG. 3, a spring 30*a*, spiral pin 30*b* or any combination thereof or other appropriate means, may be employed to enable folding rod 3 and first prodder 20 into their respective receiving portions of handle 5. A pin 30*c* may be used to form a pin connection to enable attaching and detaching second prodder 9 to and from handle 5.

It is noted that in FIG. 3, for the sake of convenience, second prodder 9 is illustrated incorporating fewer modular connector elements 1 than the second prodder 9 of the embodiment illustrated in FIG. 2. Second prodder 9 may be lengthened or shortened according to the needs of the user. First prodder 20 may be provided as a separate component of the device, and may be detachable from the device.

As seen in FIG. 3, when weighted element 10 is not in use, cord 7 may be wound around a portion of weighted element 10 to allow for storage inside the handle 5. It should be appreciated, however, that the invention is not limited to this arrangement and other storage arrangements are possible within the scope of the invention.

Furthermore, as it would be evident to those skilled in the art, other aspects of the invention may be modified without departing from the scope of the invention, as set out in the claims.

What is claimed is:

1. A method for detection of above-waist and below-waist strategic devices, the method comprising:

providing a hand-held multi-task device comprising a handle with a weighted element suspended from the handle by a cord, wherein a below-waist strategic device upon contacting said weighted element causes a disturbance through said cord detectable by a user holding the hand-held multi-task device;

providing an adjustable length rod that extends from said handle, wherein an above-waist strategic device upon contacting said rod causes a disturbance through said rod detectable by a user holding the hand-held multi-task device; and holding said handle and checking for a below-waist strategic device with said weighted element by detecting if there is a disturbance through said cord and checking for an above-waist strategic device with said rod by detecting if there is a disturbance through said rod.

2. The method according to claim 1, further comprising adjusting a length of said cord.

3. The method according to claim 1, further comprising adjusting a length of said rod.

4. The method according to claim 1, further comprising storing said cord and said weighted element in a recess in said handle.

5. The method according to claim 1, further comprising storing said rod in a slot in said handle.

* * * * *